United States Patent [19]

Hilbern

[11] 4,160,299

[45] Jul. 10, 1979

[54] UNITARY SEAT FOR INNER TUBE FLOAT

[75] Inventor: Tom Hilbern, Spokane, Wash.

[73] Assignee: Melcher Manufacturing Co., Inc., Spokane, Wash.

[21] Appl. No.: 852,109

[22] Filed: Nov. 16, 1977

[51] Int. Cl.[2] ..... B63C 9/08

[52] U.S. Cl. ..... 9/347; 9/1.3; 9/5; 9/7; 280/12 B; 297/459

[58] Field of Search ..... 9/2 A, 347, 7, 5, 11 A, 9/348, 1.3, 340; 114/39; 272/1 B; 280/12 B, 18; 297/4, 459, DIG. 3

[56] References Cited

U.S. PATENT DOCUMENTS

| | | | |
|---|---|---|---|
| 1,245,098 | 10/1917 | Goldthwait | 9/7 |
| 1,838,086 | 12/1931 | Farnstrom | 9/347 |
| 1,869,186 | 7/1932 | Davidson | 9/347 |
| 2,156,175 | 4/1939 | Brown | 9/2 A |
| 2,958,876 | 11/1960 | Garrett | 9/347 |
| 3,748,672 | 7/1973 | Patrick et al. | 9/347 |
| 3,769,645 | 11/1973 | Lettman | 9/7 |

FOREIGN PATENT DOCUMENTS

| | | | |
|---|---|---|---|
| 322299 | 12/1929 | United Kingdom | 9/347 |

*Primary Examiner*—Douglas C. Butler
*Attorney, Agent, or Firm*—Wells, St. John & Roberts

[57] ABSTRACT

An inner tube seat is described for attachment to an inflated inner tube for the purpose of supporting a user above a water surface while enabling him to use his feet and legs for propulsion. The seat is comprised of a semi-rigid elongated seat member formed with integral arcuate ends that conform to the configuration of an inflated inner tube section. The seat member extends across the full diameter of the tube but does not span the entire central opening of the tube, thereby leaving a crescent shaped opening for access by the user's legs. The seat member also includes forward and rearward side edges. The forward side edge includes a smooth curved downwardly turned edge surface against which the user may rest his legs. The rearward side edge is arcuate to conform to that portion of the inner tube engaged thereby. Intermediate the ends is a section which is recessed and shaped to conform to the user's buttocks and upper legs. This surface is located to be well above the water level to situate the user's torso at a sufficient elevation above the water level to enable free movement of the arms for fishing or hunting.

4 Claims, 3 Drawing Figures

UNITARY SEAT FOR INNER TUBE FLOAT

BACKGROUND OF THE INVENTION

The present invention relates to apparatus that is mountable to an inflated inner tube to provide a support for a user and more particularly to such apparatus utilized to support a substantial part of the user's body above the water level.

It is often desirable for fishermen to reach offshore locations in areas where the water is too deep for wading and there is no access for launching a boat. Further, fishing boats both of the fixed hull variety and the inflated structures are heavy and cumbersome in addition to being expensive. It therefore become desirable to obtain some form of seaworthy transportation that may be inexpensive in relation to fishing boats and easily transported to and from remote and otherwise inaccessible areas for the purpose of supporting and enabling propulsion of a fisherman in offshore waters that are too deep for wading.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
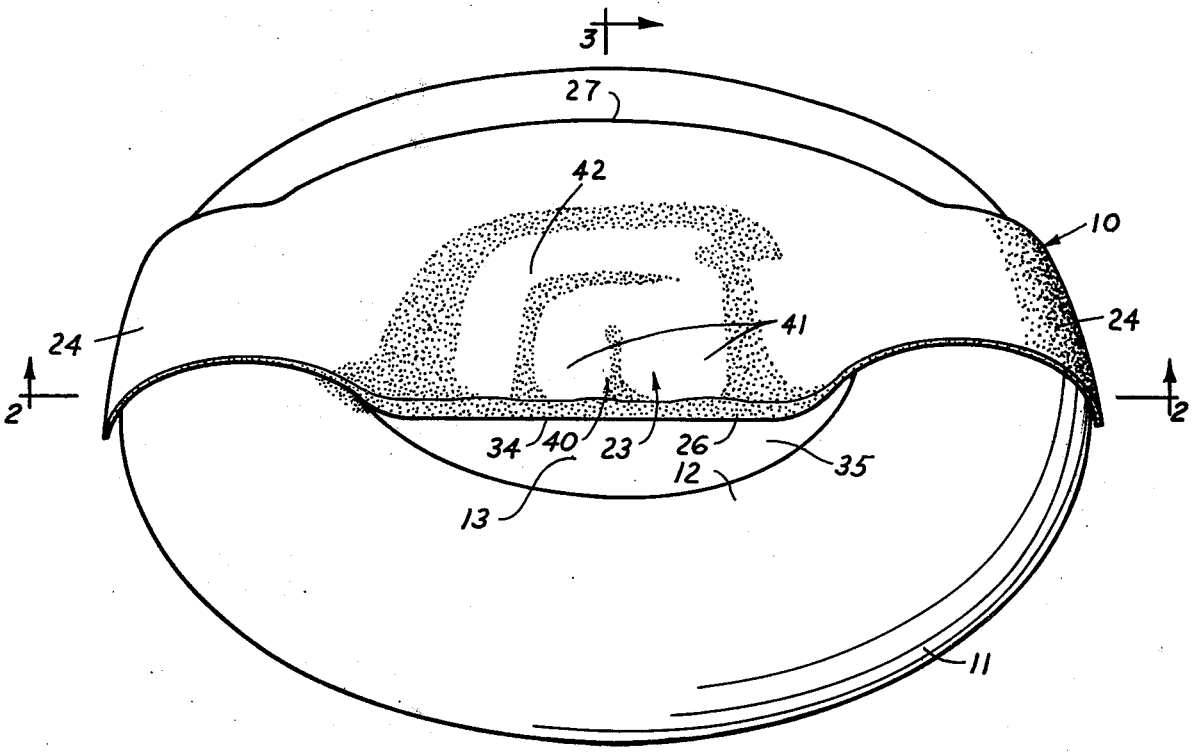
FIG. 1 is a pictorial view of the present apparatus mounted to an inflated inner tube.

An inner tube seat comprising a preferred form of the invention as illustrated in the drawings and is generally designated herein by the reference character 10. The present unitary seat 10 is designed to be mounted to an inflated inner tube such as shown at 11. The seat 10 may be constructed for specific size inner tubes 11, and, since there is a variety of inner tube sizes, it is contemplated that the seat can be constructed in forms substantially as shown that will correspond to the various tube sizes.

Figure 2:
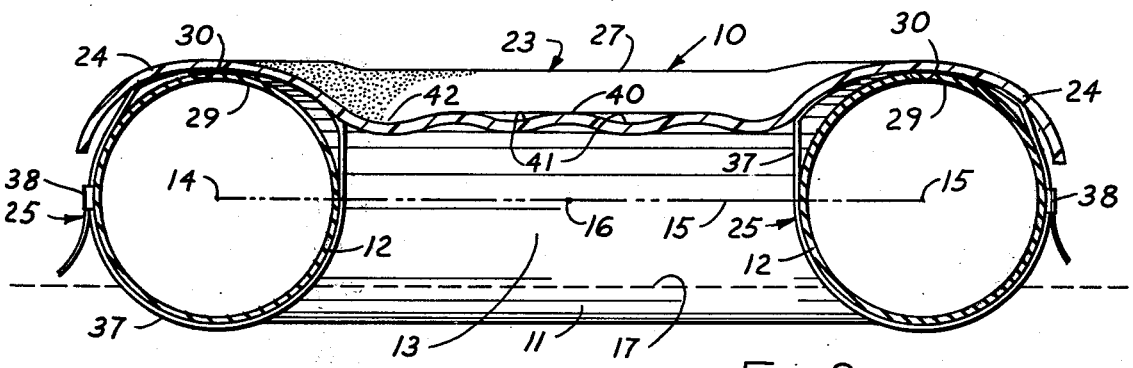
FIG. 2 is an elevational section view taken substantially along line 2—2 in FIG. 1.

The inner tube 11 typically includes a closed curved surface 12 formed in the shape of a torus. The surface 12 defines a central circular opening 13. The curved surface 12 is formed about a circular locus of center points that are indicated in FIG. 2 by center points 14. This locus of points 14 lies along a plane 15 that substantially bisects the inner tube forming two matching circular halves. The locus of points 14 is generated in a circle the center of which is indicated at 16 on the plane 15. Also indicated in FIG. 2 is a dashed line 17 that represents the water line at which the inner tube will ordinarily float.

Figure 3:
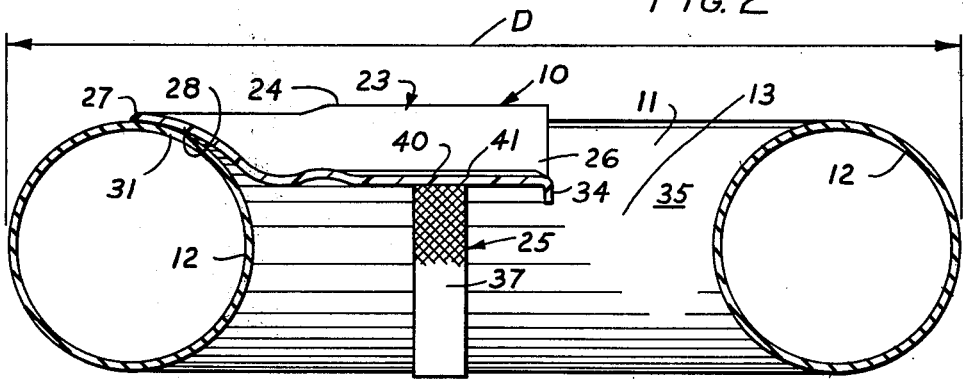
FIG. 3 is a sectional view taken substantially along line 3—3 in FIG. 1.

The seat 10 is comprised of a semi-rigid elongated seat member 23 that is releasably mounted by a fastening means 25 to the inner tube 11. The semi-rigid elongated seat member 23 includes integral arcuate end sections 24, a front side section 26, a rear side section 27 and a central seat section 40. The member 23 includes a length dimension between the arcuate end sections 24 that is substantially equal to the outside diameter of the inner tube, the dimension of which is indicated in FIG. 3 at D.

The arcuate end sections 24 are substantially concave and are complementary in configuration to the curvature of the tube surface 12. As shown in FIG. 2, the ends 24 engage substantially diametrically opposed portions 29 of the tube 11 with concave downwardly facing surfaces 30. Surfaces 30 may be in complete contact with the adjacent inner tube surfaces 29 depending upon the degree of inflation of the inner tube.

The end sections 24 are formed integrally with the central seat section 40 and extend initially upward and outward from the seat section 40 and then downward and outward terminating in a peripheral edge.

The front side section 26 extends along the front side of the central seat section 40 and spans the central circular opening 13. However, the front section 26 is located near the center 16 so as to leave a crescent shaped portion 35 of opening 13. Opening portion 35 is of sufficient size to readily receive and permit free movement of the user's legs while he is seated on member 23.

The front side section 26 includes a downwardly turned smooth edge surface 34 that extends across the opening 13. This curved surface is provided to prevent chafing and gouging of the user's legs when he is seated on member 23 with his legs extending through the crescent shaped portion 35 of the opening 13.

The rear or back side section 27 also extends between the arcuate end section 24. However, section 27 is annularly disposed between the end section 24 and along the central seat section 40 to conform to a portion 31 of the tube engaged thereby. In other words, the rear side section 27 is annularly disposed to match the curvature formed by the surface 12 as generated about the locus 14. The rear section 27 is formed integrally with the central seat section 40 and extends outward and upward from the central seat section 40 forming a concave surface 28 that engages and bears against the tube portion 31 as indicated in FIG. 3.

The entire rigid elongated seat member 23 is supported on the inner tube by the end sections 24 and the rearward side section 27. Sections 24 and section 27 support the seat member 23 at an elevation substantially above the water level 17. Thus, a fisherman resting his entire weight on the seat member 23 may remain supported (by sitting with his legs resting on top of the tube) or he may sit entirely above the water level with only his lower legs immersed in the water.

The actual portion of the seat member 23 at which the user sits is the central seat section 40. The seat section 40 includes an integral U-shaped seat indentation 41 which conforms to the user's buttocks and upper legs. The indentation 41 is centrally located to position the user's legs centrally within the crescent shaped portion 35 of opening 13 to enable maximum freedom of movement. Furthermore, the seat section 40 includes a U-shaped or C-shaped indentation 42 spaced outward from and surrounding indentation 41 that communicates with the front edge 26 to drain any water from the seat to minimize wetting the buttocks of the user.

The elongated seat member is removably mounted to an inflated inner tube 11 through the function of the fastening means 25. Means 25 is simply comprised of a strap 37 and buckle 38 at each end 24. The buckle 38 is mounted on the strap 37. Straps 37 are rigidly affixed to the elongated seat member 23 at the sections 24 along the surfaces 30. Attachment of the straps to the member 23 may be achieved by means of glue, mechanical fastening mechanisms, or they may be molded integrally with the seat member if it is formed in that manner.

It is preferable that the seat member be formed of a single sheet of synthetic resin material. Preferably, this sheet material will be comprised of reinforced synthetic resin such as fiberglass that may be molded to conform to the configuration shown in the drawings. However, regardless of the form of manufacture, the seat member 23 may be formed of sheet material having uniform thickness so long as it provides sufficient rigidity to support the weight of a user between its ends and sides.

Prior to using the present seat 10, a selected inner tube 11 is first inflated to a desired pressure and the seat is attached through provision of the fastening means 25. In mounting the seat to the tube 11, the user extends the straps 37 about the curved surface 12 to engage the buckles 38. He then secures the straps to the buckles by threading them through appropriate apertures. He may then tighten the belts to thereby secure the seat to the tube as shown in the drawings. The seat is then ready for use.

To use the apparatus, the user steps through the crescent shaped opening 35 with both feet and wades into the water until he can sit on the indentation 41 without his feet touching bottom. Then, by kicking his feet, he may propel himself through the water at a desired rate of speed and in any desired direction.

It is noted that the propulsion may be accomplished by the feet alone, thereby freeing the user's arms for fishing. This is a distinct advantage even in comparison with outboard powered boats where the user must use one hand to control the boat motor while the other holds a fishing pole.

The elevation of the seat places the user at a position above the water surface such that the greater part of his torso is located above the water level and with only his lower legs and feet submerged. This feature will be appreciated in cold water. In addition, the high elevation of support places the user above the tube level so that he may have nearly completely free use of his arms for the purpose of handling a fishing pole.

It is understood that various changes and modifications can be made from the above description and attached drawings. It is therefore intended that only the following claims be taken as strict definitions of what I claim to be my invention.

What I claim is:

1. A unitary seat for attaching to an inflatable toroidal inner tube float to enable a user to comfortably sit thereon and extend his legs downwardly into a body of water to manually propel the inner tube float, said tube float having a closed curve toroidal surface extending angularly about a circular central opening with a tube float having an inner diameter defining a parameter of the circular central opening and an outer diameter defining the parameter of the tube float, comprising:

a semi-rigid elongated seat member, formed of a single sheet of synthetic resin having a uniform thickness dimension, having a length dimension corresponding substantially to the outer diameter of the tube float and a width dimension less than the inner diameter of the tube float;

said seat member having a central seat section for extending across a first portion of the circular central opening while leaving a second portion of the circular central opening unrestricted to enable the user to project his legs therethrough into the body of water to manually propel the inner tube float;

said seat member having curved end sections that are formed integrally with the central seat section that extend initially outward and upward from the seat section and then outward and downward in a concave shape conforming to the curved surface of the inner tube float for extending over angularly spaced locations of the inner tube float to support the seat section on the inner tube float above water level; a curved front section that is formed integrally with the seat section and extends downward from the seat section to present a smooth curved front surface between the end sections against which the user's legs may rest;

said seat member having a curved rear section that is (1) formed initially with the seat section and extends upward and outward from the seat section conforming to the curved surface of the inner tube float, and (2) formed integrally with the end sections extending annularly about the seat section between the end section complementary with a portion of the parameter of the circular central opening for engaging the tube float between the spaced locations to additionally support the central seat section above the water level; and fastening means at the end sections for releasably securing the seat member to the inflatable inner tube float.

2. The unitary seat as defined in claim 1 wherein the fastening means is comprised of a strap member and a buckle member affixed at each end section, said strap having a sufficient length to extend about a portion of the inflated inner tube float and engage the buckle member.

3. The unitary seat as defined in claim 1 wherein the seat section includes a "U" shaped buttocks and upper legs indentation formed therein extending to the front section.

4. The unitary seat as defined in claim 3 wherein the seat section includes an annular indentation spaced outward from and surrounding the buttocks and upper legs indentation and communicating with the front edge surface of the front section to direct any water from the seat section to the front section.

* * * * *